US005580309A

United States Patent [19]

Piechowiak et al.

[11] Patent Number: 5,580,309

[45] Date of Patent: Dec. 3, 1996

[54] LINKED GAMING MACHINES HAVING A COMMON FEATURE CONTROLLER

[75] Inventors: Robert J. Piechowiak; Curtis J. Crawford, both of Las Vegas, Nev.

[73] Assignee: Sigma Game, Inc., Las Vegas, Nev.

[21] Appl. No.: 200,121

[22] Filed: Feb. 22, 1994

[51] Int. Cl.[6] ..... G07F 17/34

[52] U.S. Cl. ..... 463/16; 463/20; 463/25

[58] Field of Search ..... 273/143 R, 138 A, 273/85 CP, 143 A, 138 R; 463/16, 25, 17, 18, 19, 20, 21, 42

[56] References Cited

U.S. PATENT DOCUMENTS

| | | | |
|---|---|---|---|
| 4,095,795 | 6/1978 | Saxton et al. | 273/143 R |
| 4,572,509 | 2/1986 | Sitrick | 273/85 G |
| 4,593,904 | 6/1986 | Graves | 273/1 E |
| 4,636,951 | 1/1987 | Harlick | 364/412 |
| 4,837,728 | 6/1989 | Barrie et al. | 364/412 |
| 4,964,638 | 10/1990 | Ishida | 273/143 R |
| 5,116,055 | 5/1992 | Tracy | 273/138 |
| 5,249,800 | 10/1993 | Hilgendorf | 273/138 A |
| 5,280,909 | 1/1994 | Tracy | 273/138 A |
| 5,393,061 | 2/1995 | Manship et al. | 273/138 A |
| 5,401,023 | 3/1995 | Wood | 273/138 A |

FOREIGN PATENT DOCUMENTS

| | | | |
|---|---|---|---|
| 0015081 | 9/1980 | European Pat. Off. . | |
| 0342797 | 11/1989 | European Pat. Off. . | |
| 0521599 | 1/1993 | European Pat. Off. . | |
| 5184724 | 7/1993 | Japan | 273/138 A |
| 5208069 | 8/1993 | Japan | 273/138 A |
| 2092796 | 8/1982 | United Kingdom | 273/143 R |
| 2098778 | 11/1982 | United Kingdom . | |
| 2180087 | 3/1987 | United Kingdom | 273/143 R |
| 2201279 | 8/1988 | United Kingdom | 273/143 R |
| 2205214 | 11/1988 | United Kingdom | 273/138 A |

*Primary Examiner*—Jessica Harrison

*Attorney, Agent, or Firm*—Skjerven, Morrill, MacPherson, Franklin & Friel LLP; Brian D. Ogonowsky; William L. Paradice, III

[57] ABSTRACT

The preferred embodiment of the present invention operates on a system of interconnected gaming machines and selectively provides one or more active features to all of the gaming machines linked to the system. The enablement of the feature may be based on the combined results from previous plays on the individual gaming machines. The feature may be a bonus award for a specific displayed combination, an increased possibility for a winning combination, or any other feature which alters the normal operation of the gaming machines. The first machine to generate a winning game result to which the feature applies will be given an award based upon the feature. The feature is then disabled and the system returns to normal play mode until the feature is again enabled. Various other features are described.

25 Claims, 2 Drawing Sheets

LINKED GAMING MACHINES HAVING A COMMON FEATURE CONTROLLER

FIELD OF THE INVENTION

The present invention relates to electronic gaming devices. More particularly, the present invention relates to controlling features available to linked electronic gaming machines.

BACKGROUND OF THE INVENTION

Modern gaming machines are typically electronically controlled, as opposed to mechanically controlled. For example, U.S. Pat. No. 4,095,795 to Saxton et al., incorporated herein by reference, discloses a slot machine having a computer which randomly generates a series of numbers corresponding to stopping positions of each reel in the machine. After causing the reels to rotate for a period of time, the machine then stops the reels at their previously determined stopping positions.

This general type of computer controlled gaming machine allows similar gaming machines to be electronically linked together to share a common jackpot. This is because the final game results and the jackpot award can be electronically communicated between a central jackpot controller and the various linked gaming machines. Progressive jackpot gaming systems, comprised of one or more interconnected gaming machines which award a progressive jackpot award, are well known. By allowing players to win a large progressive jackpot award in addition to the customary payout for winning combinations, the players enjoy a heightened interest and enthusiasm in the gaming machines. This heightened enthusiasm translates into higher revenue for gaming machine proprietors. U.S. Pat. No. 4,837,728 to Barrie et al., incorporated herein by reference, describes one such progressive gaming system comprised of linked slot machines. The circuitry and software used to fabricate and operate these conventional linked gaming machines are well known to those skilled in the art.

SUMMARY OF THE INVENTION

The preferred embodiment of the present invention operates on a system of interconnected gaming machines and selectively provides one or more active features to all of the gaming machines linked to the system. The enablement of the feature may be based on the combined results from previous plays on the individual gaming machines, or the enablement of the feature may be based on some other criteria such as time. The feature may be a bonus award for a specific displayed combination, an increased possibility for a winning combination, or any other feature which alters the normal operation of the gaming machines.

The first machine to generate a winning game result to which the feature applies will be given an award based upon the feature. The feature is then disabled and the system returns to normal play mode until the feature is again enable. The feature may also be disabled after a period of time.

In another embodiment, only selected ones of the gaming machines are temporarily provided with a certain feature, where the feature is enabled based on the occurrence of some event.

DETAILED DESCRIPTION OF THE PREFERRED EMBODIMENTS

Figure 1:
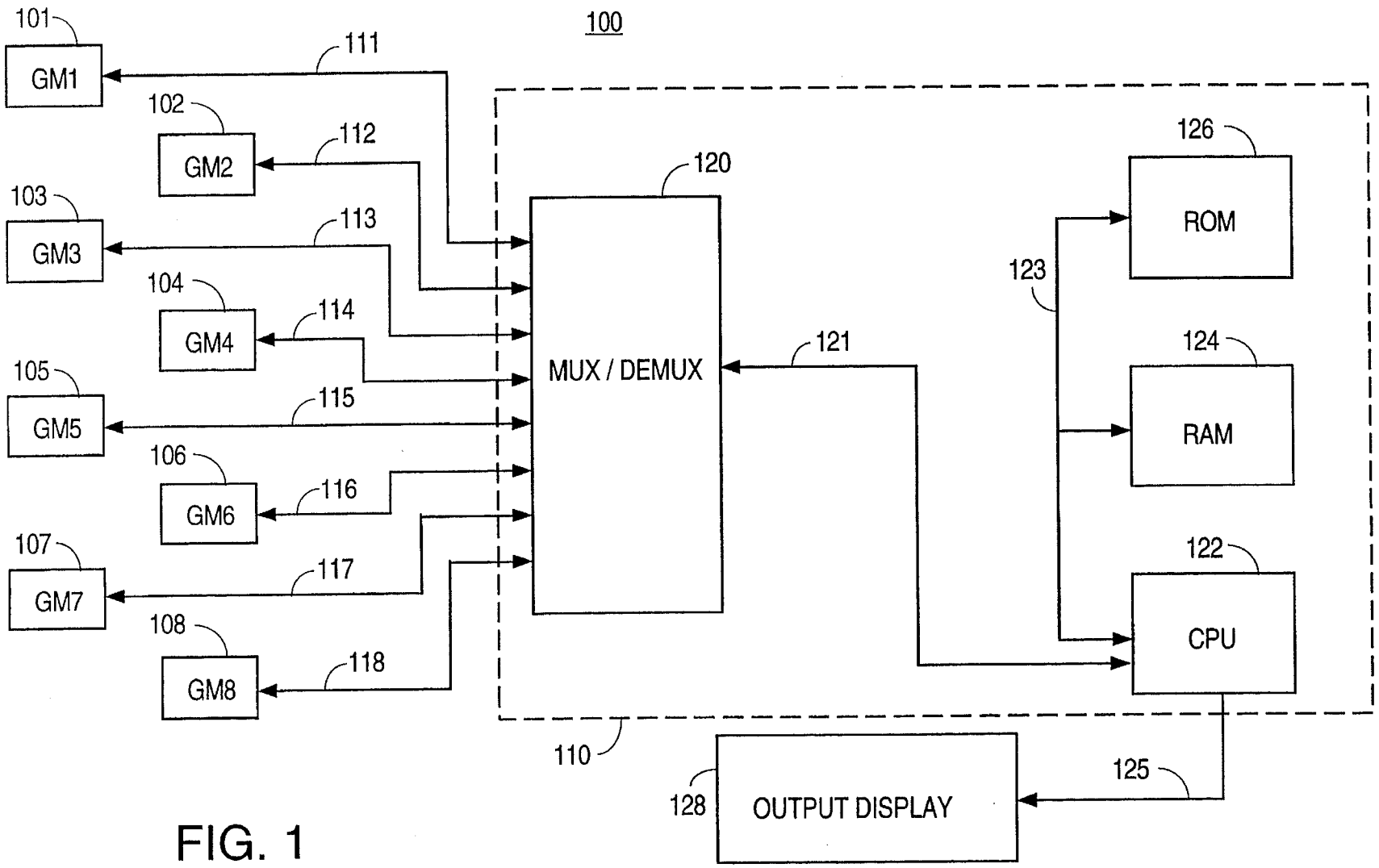
FIG. 1 illustrates one embodiment of a circuit which may be used to implement the present invention.

FIG. 1 illustrates a linked gaming system 100 which incorporates the present invention. Other circuitry for implementing the invention may also be used. The system 100 includes linked gaming machines 101–108 (which may be conventional electronically operated slot machines), multiplexer/de-multiplexer circuit (MUX) 120, central processing unit (CPU) 122, random access memory (RAM) 124, read only memory (ROM) 126, and output display device 128. MUX 120 may be replaced with an address/data bus and suitable decoders within the gaming machines 101–108 so that the gaming machines 101–108 can be addressed using digital codes. The circuit within the dashed line will be referred to as a feature controller 110.

Linked gaming machines 101–108 transmit game information to and receive feature information from feature controller 110 through MUX 120 (or a suitable address/data bus) via bi-directional communication lines 111–118. Such game information may include digital codes representing a final displayed combination of symbols in a slot machine. Such digital codes are normally generated in conventional slot machines for addressing an award table stored in a memory in the slot machine. CPU 122 controls MUX 120 and receives/transmits data from/to the gaming machines 101–108 via communication lines 121.

CPU 122, RAM 124, and ROM 126 are connected together via communication lines 123 and control the operation of gaming system 100. RAM 124 is used to temporarily store data generated by CPU 122. CPU 122 is coupled to and controls output display 128 via lines 125. The operation of feature controller 110 is controlled by a program stored in ROM 126. The circuitry used in feature controller 110 to carry out the programmed instructions would be known by those skilled in the art after reading this disclosure.

Figure 2:
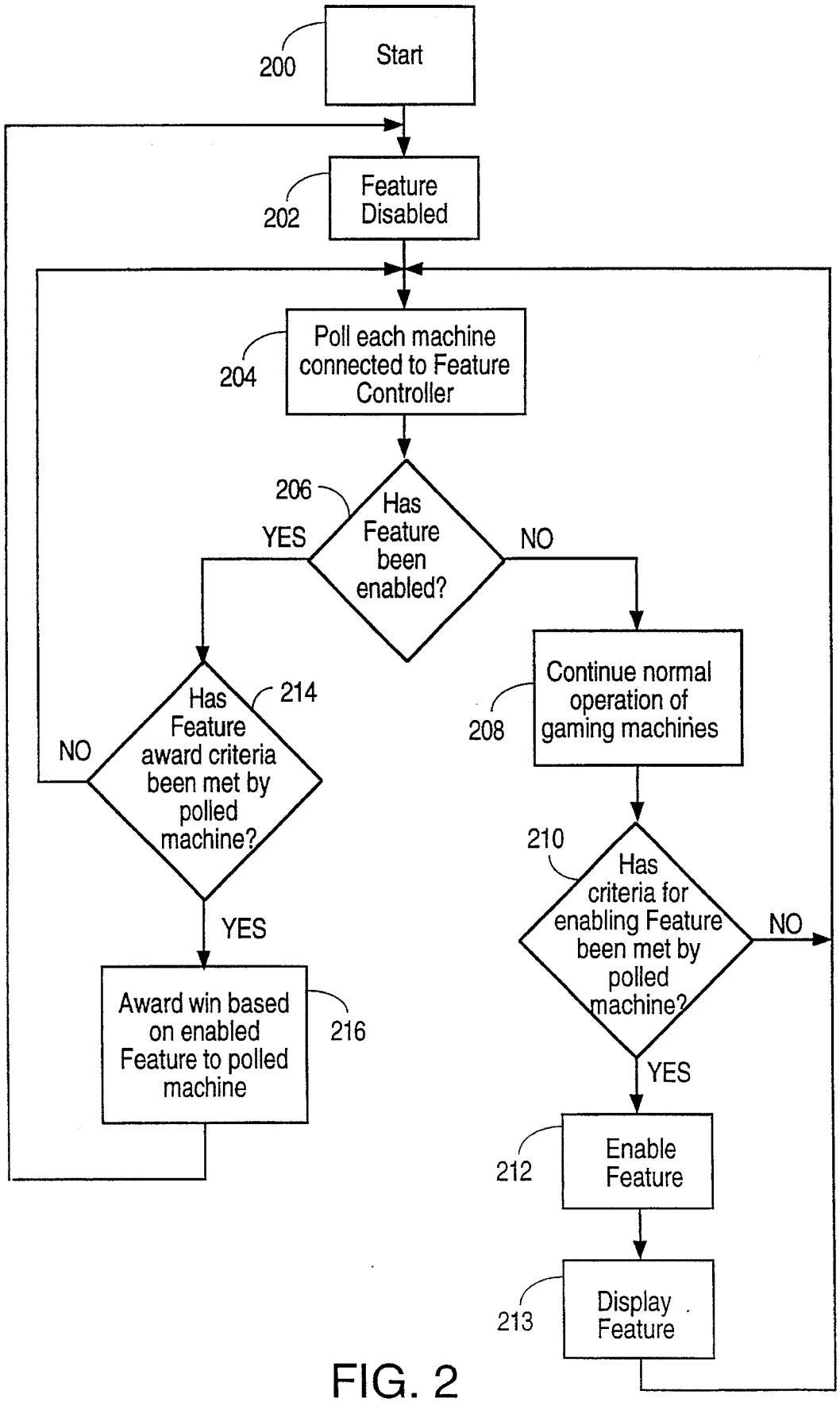
FIG. 2 is a flowchart which shows the basic steps used in one embodiment of the invention.

FIG. 2 is a flow chart illustrating an operation of a linked gaming system 100 in accordance with an embodiment of the present invention. Such an operation may be controlled by a program stored in ROM 126.

The system 100 is powered up in a start step 200. During normal operation of the gaming system 100, feature controller 110 disables one or more of the particular features under the command of the feature controller 110 (step 202). Gaming machines 101–108 may operate independently of each other during this normal operation mode and award wins based upon a normal payout criteria stored in either ROM 126 of feature controller 110 or in a memory (i.e., an award table) contained within each of the linked gaming machines. Feature controller 110 periodically polls each of the gaming machines 101–108, using MUX 120 (or an address/data bus) and using conventional polling techniques, for game results generated in each of the linked gaming machines (step 204). Polling may be performed by sequentially accessing the gaming machines 101–108 in the system and reading the current game results. If the feature has not yet been enabled (step 206) by the feature controller 110, gaming machines 101–108 continue normal operation (step 208).

In step 210, feature controller 110 compares the game results of each gaming machine 101–108 polled to feature enabling criteria stored in ROM 126 (or elsewhere) to determine whether one or more predetermined features should be enabled. The feature enabling criteria may consist of any of a variety of conditions. For example, in one embodiment, a criterion for enabling the feature may be a specified number of occurrences of a predetermined combination of indica displayed by the gaming machines 101–108. Thus, for example, the feature may be enabled for a system of linked slot machines when four like symbols have been displayed a total of four times by the linked slot machines.

If the feature controller 110 determines in step 210 that the feature enabling criteri has not meet met (e.g., the game results indicate that four-of-a-kind have not yet been generated four times by linked gaming machines 101–108), the feature remains disabled and the linked gaming machines 101–108 are again polled (step 204). Steps 204, 206, 208, and 210 are repeated until the game results generated by one or more of linked gaming machines 101–108 meet the feature enabling criteria.

If the feature enabling criteria has been met (step 210) by the game results, feature controller 110 enables the feature (step 212), and this enabled feature is now prominently displayed (step 213) by output display 128 to attract new players and heighten excitement. At this point, the feature is made available to all linked gaming machines 101–108. The various players now play the gaming machines 101–108 having the enabled features. Feature controller 110 again polls each of linked gaming machines 101–108 (step 204) and, with the feature now enabled (step 206), determines whether the feature award criteria stored in ROM 126 has been met by any of the polled machines (step 214). Feature controller 110 then awards a win, based upon the enabled feature, to the first linked gaming machine to generate a game result which matches the feature award criteria (step 216). In one embodiment, the feature operates to double the award normally associated with a certain game result (e.g., four-of-a-kind). In other embodiments, the feature may operate to multiply the award normally given for a certain game result by a predetermined factor greater than one.

Instead of the feature controller 110 determining a win based on the polled game results and communicating the award amount to the gaming machine, feature controller 110 could modify the award table in each of the gaming machines 101–108, via communication lines 111–118, to reflect the enable feature. The gaming machine would then compare its game result to the award table and then provide a corresponding award. In this embodiment, feature controller 110 would still poll the various gaming machines to determine whether the feature should be enabled or disabled in the various award tables.

After a match is found and a win awarded (step 216) in accordance with the feature, the feature is then disabled (step 202) and all linked gaming machines 101–108 return to normal operation. Gaming machines 101–108 will remain in normal operation until feature controller 110 again enables the feature (step 212).

If no game result of linked gaming machines 101–108 matches he feature award criteria, steps 204, 206, and 214 are repeated until one of linked gaming machines 101–108 is awarded a win based upon the feature. In another embodiment, the feature is automatically disabled after a period of time. This period of time may be displayed by display 128.

In accordance with the present invention, both the feature award criteria and the feature enabling criteria may embody various conditions in addition to those previously discussed. For instance, in some embodiments the feature enabling criteria stored in ROM 126 (or elsewhere) may be a predetermined lapse of time between periods during which the feature has been disabled; for example, feature controller 110 may enable the feature 10 minutes after the feature was last disabled.

To attract more non-player interest in the gaming machines, the feature enabling criteria may be a predetermined lapse of time during which one or more of linked gaming machines 101–108 has not been played. And in yet another embodiment, the feature is enabled in a purely random manner.

Similarly, the feature award criteria stored in ROM 126 may take on many forms. For example, the feature award criterion may be the display by one of the linked gaming machines 101–108 of a certain combination of symbols (e.g., four-of-a-kind), in which case the feature will award an enhanced amount (i.e., a bonus). The feature may even offer the gaming machine players a greater variety of winning possibilities, thereby increasing player interest in the linked gaming system 100. Hence, the feature award criteria may be a special or randomly chosen combination of symbols which will incur an enhanced award being given to the player. In another embodiment, the feature may provide a more nonconventional award by the linked gaming device meeting the feature award criteria, such as free game credits or other prizes.

It is to be understood that the embodiments described above as applied to linked gaming machines which display symbols on drums or reels can also be applied to machines in which the indicia are displayed on video screens, as well as to other video displayed games, including but not limited to poker gaming machines, blackjack gaming machines, and roulette gaming machines.

While particular embodiments of the present invention have been shown and described, it will be obvious to those skilled in the art that changes and modifications may be made without departing from this invention in its broader aspects and, therefore, the appended claims are to encompass within their scope all such changes and modifications as fall within the true spirit and scope of this invention.

What is claimed is:

1. A method of operating a system of linked gaming machines in which an award is given based on an award criteria, said method comprising the steps of:

generating during a period of time one or more combinations of symbols in one or more of said linked gaming machines;

determining, based upon said one or more combinations of symbols generated during said period of time, whether a first criterion has been met for making a feature available to said linked gaming machines, said feature, when available to said linked gaming machines, operating to alter said award given by said linked gaming machines;

making said feature available to said linked gaming machines after it has been determined that said first criterion has been met;

generating one or more combinations of symbols in one or more of said linked gaming machines after said feature has been made available;

comparing said one or more combinations of symbols generated after said feature has been made available to a predetermined award criterion to which said feature applies;

giving an award by one or more of said linked gaming machines based upon whether said one or more combinations of symbols generated after said feature has been made available matches said predetermined award criterion; and making said feature not available to said linked gaming machines after it has been determined that a second criterion has been met.

2. The method of claim 1 further comprising the step of displaying said feature on one or more display devices when said feature is available to said linked gaming machines.

3. The method of claim 1 wherein said feature is made available to said linked gaming machines when a predetermined number of said combinations of symbols generated during said period of time match said first criterion.

4. The method of claim 1 wherein said predetermined award criterion is a specified combination of symbols displayed by one or more of said linked gaming machines.

5. The method of claim 1 wherein said feature is made available to said linked gaming machines after a predetermined number of occurrences of a specified combination of symbols displayed by said linked gaming machines.

6. The method of claim 1 wherein said feature multiplies an award normally given for a certain game result by a predetermined factor, said predetermined factor being a number greater than 1.

7. The method of claim 1 wherein said feature provides additional winning combinations for said linked gaming machines.

8. The method of claim 1 wherein, after said feature is made available to said linked gaming machines, said feature is made not available after one of said linked gaming machines has generated a combinations of symbols which meets said predetermined award criterion to which said feature applies.

9. The method of claim 1 wherein, after said feature is made available to said linked gaming machines, said feature is made not available after a period of time.

10. The method of claim 1 wherein, after said first criterion has been met, said feature is made available to each of said linked gaming machines prior to a next operation of any of said linked gaming machines by any players of said linked gaming machines.

11. The method of claim 1 wherein said feature is made available to all of the linked gaming machines forming said system of linked gaming machines once said first criterion has been met.

12. A system of linked gaming machines for giving an award based on an award criteria, said system comprising:

a feature controller coupled to each of said linked gaming machines, said feature controller comprising a computer for determining when a feature is to be made available and not available to said linked gaming machines, based upon previous combinations of symbols generated by one or more of said linked gaming machines, wherein said feature operates to alter an award payable by said linked gaming machines; and a display device for displaying said feature when said feature is made available.

13. The system of claim 12 wherein said feature controller makes said feature available to said linked gaming machines when a predetermined number of game results match a first criterion.

14. The system of claim 12 wherein said feature controller makes said feature available to said linked gaming machines at a predetermined time interval.

15. The system of claim 12 wherein said feature controller makes said feature available to said linked gaming machines at a random time interval.

16. The system of claim 12 wherein said feature controller temporarily makes said feature available for a first predetermined period of time.

17. The system of claim 12 wherein, after said feature is made available to said linked gaming machines, said feature is made not available after one of said linked gaming machines has generated a combinations of symbols which meets a predetermined award criterion to which said feature applies.

18. The system of claim 12 wherein said feature provides additional winning combinations for said linked gaming machines.

19. The system of claim 12 wherein said feature multiplies an award normally given for a certain game result by a predetermined factor, said predetermined factor being a number greater than 1.

20. The system of claim 12 wherein said feature, when made available to said linked gaming machines, is made available to all the linked gaming machines forming said system of linked gaming machines.

21. A method of operating a system of linked gaming machines in which an award is given based on an award criteria, said method comprising the steps of:

generating one or more combinations of symbols in one or more of said linked gaming machines;

determining based upon previous combinations of symbols generated by one or more of said linked gaming machines whether a first criterion has been met for making a feature available to said linked gaming machines, said feature, when available to said linked gaming machines, operating to alter said award given by said linked gaming machines;

making said feature available to said linked gaming machines after it has been determined that said first criterion has been met;

displaying said feature, after said feature has been made available to said linked gaming machines, on one or more display devices observable by all players of said linked gaming machines prior to a next operation of any of said linked gaming machines by said players;

generating, after said feature has been made available, one or more combinations of symbols in one or more of said linked gaming machines;

comparing said one or more combinations of symbols generated after said feature has been made available to a predetermined award criterion to which said feature applies;

giving an award by one or more of said linked gaming machines based upon whether said one or more combinations of symbols generated after said feature has been made available matches said predetermined award criterion; and making said feature not available to said linked gaming machines after it has been determined that a second criterion has been met.

22. The method of claim 21 wherein said feature is made available to said linked gaming machines at a predetermined time interval.

23. The method of claim 21 wherein said feature is made available to said linked gaming machines at a random time interval.

24. The method of claim 21 wherein said feature is made available to said linked gaming machines when one or more of said linked gaming machines has not generated said game results for a predetermined period of time.

25. The method of claim 21 wherein said feature is made available to all of the linked gaming machines forming said system of linked gaming machines once said first criterion has been met.

* * * * *